US006565025B2

(12) United States Patent
Zortman et al.

(10) Patent No.: US 6,565,025 B2
(45) Date of Patent: May 20, 2003

(54) GYRATORY CRUSHER BEARING RETAINER SYSTEM

(75) Inventors: Brek M. Zortman, Waukesha, WI (US); Albert J. Van Mullem, Sussex, WI (US)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/755,430

(22) Filed: Jan. 5, 2001

(65) Prior Publication Data

US 2002/0088884 A1 Jul. 11, 2002

(51) Int. Cl.[7] ..... B02C 2/06
(52) U.S. Cl. ..... 241/210
(58) Field of Search ..... 241/209–215

(56) References Cited

U.S. PATENT DOCUMENTS

| | | | | |
|---|---|---|---|---|
| 3,924,815 | A | 12/1975 | Haggren | |
| 4,179,076 | A | 12/1979 | Barrot et al. | |
| 4,384,684 | A | 5/1983 | Karra | |
| 4,410,143 | A | 10/1983 | Polinski | |
| 4,467,971 | A | 8/1984 | Schuman | |
| 4,478,373 | A | 10/1984 | Gieschen | |
| 4,519,551 | A | 5/1985 | Ceurvorst | |
| 4,659,026 | A | 4/1987 | Krause et al. | |
| 4,750,679 | A | 6/1988 | Karra et al. | |
| 5,022,593 | A | 6/1991 | Stelk | |
| 5,031,843 | A | 7/1991 | Motz | |
| 5,080,294 | A | 1/1992 | Dean | |
| 5,372,318 | A | 12/1994 | Jacobson | |
| 5,769,340 | A | 6/1998 | Jean | |
| 5,775,607 | A | 7/1998 | Bayliss et al. | |
| 5,803,382 | A | 9/1998 | Ganser, IV et al. | |
| 5,810,269 | A | 9/1998 | Shannon | |
| 5,915,638 | A | 6/1999 | Jean | |
| 5,934,583 | A | 8/1999 | Jean | |
| 5,938,133 | A | 8/1999 | Bayliss et al. | |
| 5,944,265 | A | 8/1999 | Ganser, IV et al. | |
| 5,964,422 | A | 10/1999 | Ruokonen et al. | |
| 5,996,916 | A | 12/1999 | Musil | |
| 6,007,009 | A | 12/1999 | Sheridan et al. | |
| 6,347,758 | B1 * | 2/2002 | Mizak et al. | 241/207 |

FOREIGN PATENT DOCUMENTS

| | | | | |
|---|---|---|---|---|
| WO | WO 94/17913 | * | 2/2002 | 241/209 |

* cited by examiner

*Primary Examiner*—Mark Rosenbaum
(74) *Attorney, Agent, or Firm*—Burns, Doane, Swecker & Mathis, LLP

(57) ABSTRACT

A bearing retainer apparatus for a gyratory crusher is comprised of a bearing having a ball, a shaft disposed within the ball, and a plate secured to the shaft. Further, a method of assembling a bearing retainer system for a gyratory crusher includes attaching a bearing retainer plate onto the shaft of the crusher using bearing retainer bolts such that the bearing is clamped onto the shaft.

12 Claims, 2 Drawing Sheets

GYRATORY CRUSHER BEARING RETAINER SYSTEM

FIELD OF THE INVENTION

The present invention relates to rock crushing systems, such as conical rock crushers or gyratory crushers. More specifically, the present invention relates to a mainshaft bearing retainer for rock crushers.

BACKGROUND OF THE INVENTION

Gyratory rock crushers generally have a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle. A spider assembly rests on the top shell, forming the top of the support structure for the machine.

A shaft extends vertically through the rock crusher. This shaft is supported by a bearing in the spider assembly. The central portion of the shaft tapers inwardly in an upward direction to form the central conical crushing member. This portion of the shaft supports the mantle, which moves with the shaft to effect the crushing operation.

The spider assembly is designed to support the shaft while allowing gyratory movement during operation of the machine. Additionally, the vertical position of the shaft is controlled by a piston arrangement in the spider. The piston is slidably disposed within the spider. A bearing is disposed within the piston, and supports the shaft while allowing gyratory motion. The bearing has a hemispherical ball disposed in a socket, lubricated by oil or grease. A mechanical attachment system is required to clamp the ball to the shaft.

In previous designs, the ball has been secured to the shaft using a fastener, such as a nut. The nut is threaded onto the shaft above the ball, which in turn has a hydraulic system used to press the ball onto the shaft. In this type of arrangement, the shaft must extend through the ball to allow the nut to be threaded above the ball. The nut is retained by a bracket system bolted to the top of the shaft.

The conventional mechanical attachment systems are difficult and costly to assemble, repair, and replace because of the complexity of the arrangement. As described above, conventional systems use a hydraulic system to press the ball onto the shaft during assembly and a retainer system to prevent the nut from loosening on the shaft during operation. Further, the threaded shaft is subject to high stress in the area of its threads due to the weight of the shaft and the gyratory motion during crusher operation. Repairs to the shaft can be costly due to the expense of the shaft as well as the expense of the down time necessary to make repairs.

In contrast to conventional bearing retainer systems, it would be advantageous to have a bearing retainer arrangement that may be easily assembled, removed, and replaced. Further, there is a need for a bearing retainer system that does not require threads on the exterior of the shaft of the gyratory crusher. Further still, there is a need for a bearing retainer system that does not require a hydraulic system to assemble the ball and the shaft.

SUMMARY OF THE INVENTION

An exemplary embodiment relates to a bearing retainer apparatus. The bearing retainer apparatus is for a gyratory crusher. The bearing retainer apparatus includes a ball, a shaft disposed within the ball, and a plate configured to prevent the ball from moving upward on the shaft. The plate is secured to the shaft.

Another embodiment relates to a gyratory crusher including a shell, a shaft disposed within the shell, and a spider coupled to the shell. A bearing having a ball is disposed within the spider, and a bearing retainer plate clamps the ball to the shaft.

A still further embodiment relates to a method of assembling a bearing retainer system for a gyratory crusher having a shaft and a ball. The method includes steps of providing a bearing retainer plate, providing a plurality of bearing retainer bolts, placing the ball on the shaft, and attaching the plate to the shaft with the bolts. The ball is clamped to the shaft.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
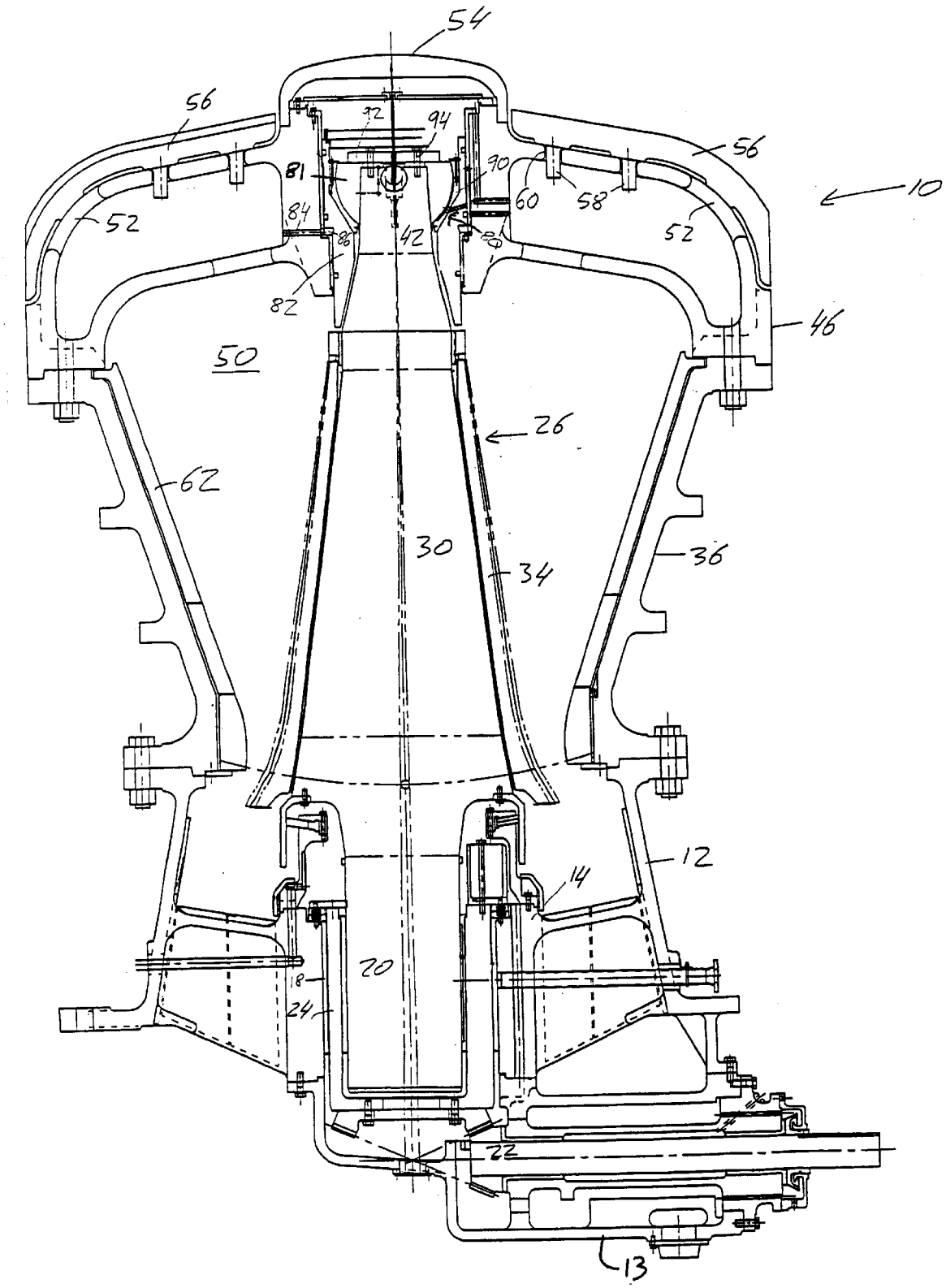
FIG. 1 is a vertical cross-sectional view of the gyratory crusher.

Referring to FIG. 1, a gyratory crusher 10 can be utilized to crush rock, ore, minerals, waste, or other material. Gyratory crusher is assembled on a cast steel base or bottom shell 12 having a central hub 14. Central hub 14 is provided with a vertical bore 18 adapted to receive a cylindrical support shaft 20 and eccentric 24. This shaft 20 varies in cross section, but extends through the machine into the spider 46. Drive housing 13 extends outwardly from hub 14 to enclose a drive mechanism 22. Drive mechanism 22 causes rotation of an eccentric 24 which directs the gyratory motion of the shaft 20.

A head assembly 26, which is part of the shaft 20, includes a head member 30 which is covered by a mantle 34. Mantle 34 provides one of the crushing surfaces of crusher 10.

A top shell 36 projects upwardly from bottom shell 12 and is covered by a spider assembly including a spider 46. Alternatively, top shell 36 and bottom shell 12 can be a single piece component. Spider 46 receives an end 42 of shaft 20.

Top shell 36 is protected from wear by several rows of concaves 62. These concaves 62 provide the crushing surface opposing mantle 34. Spider 46 can be attached or rest upon top shell 36. Vertical positioning of shaft 20 with respect to top shell 36 adjusts the relative position of the mantle 34 of the head member 26 with respect to concaves 62 thereby adjusting the size of the crushed material exiting crusher 10.

Material to be crushed is supplied through spider 46 which includes openings (not shown) for entry of the material into crushing cavity 50. A liquid flush apparatus (not shown) may be provided for spraying a liquid such as water toward the crusher cavity 50.

The spider 46 is comprised of spider arms 52 radially extending outward from the center to a spider rim (not shown). A spider cap 54 sits on the top center of the spider 46. Each of the spider arms 52 is protected from falling material by a spider arm guard 56. The spider rim is protected by a rim liner (not shown), also known as a hopper liner.

Shaft 20 is supported by a bearing 80 within spider 46. The bearing 80 is disposed within a piston 82 that travels vertically within spider 46 to adjust the vertical positioning of shaft 20. The piston 82 is moved by means of a hydraulic system including a hydraulic fluid inlet 84, and a hydraulic fluid ring 86 that is filled to move piston 82 upward. A bearing retainer plate 92 is used to clamp a bearing ball 81 to the shaft 20.

The bearing ball 81 is disposed within socket 90. It has a hemispherical structure designed to receive top end 42 of shaft 20. The ball 81 has a radius of about thirteen inches and is lubricated by oil injected between ball 81 and socket 90. An upper end of the ball has a longer horizontal dimension D than a lower end thereof.

Figure 2:
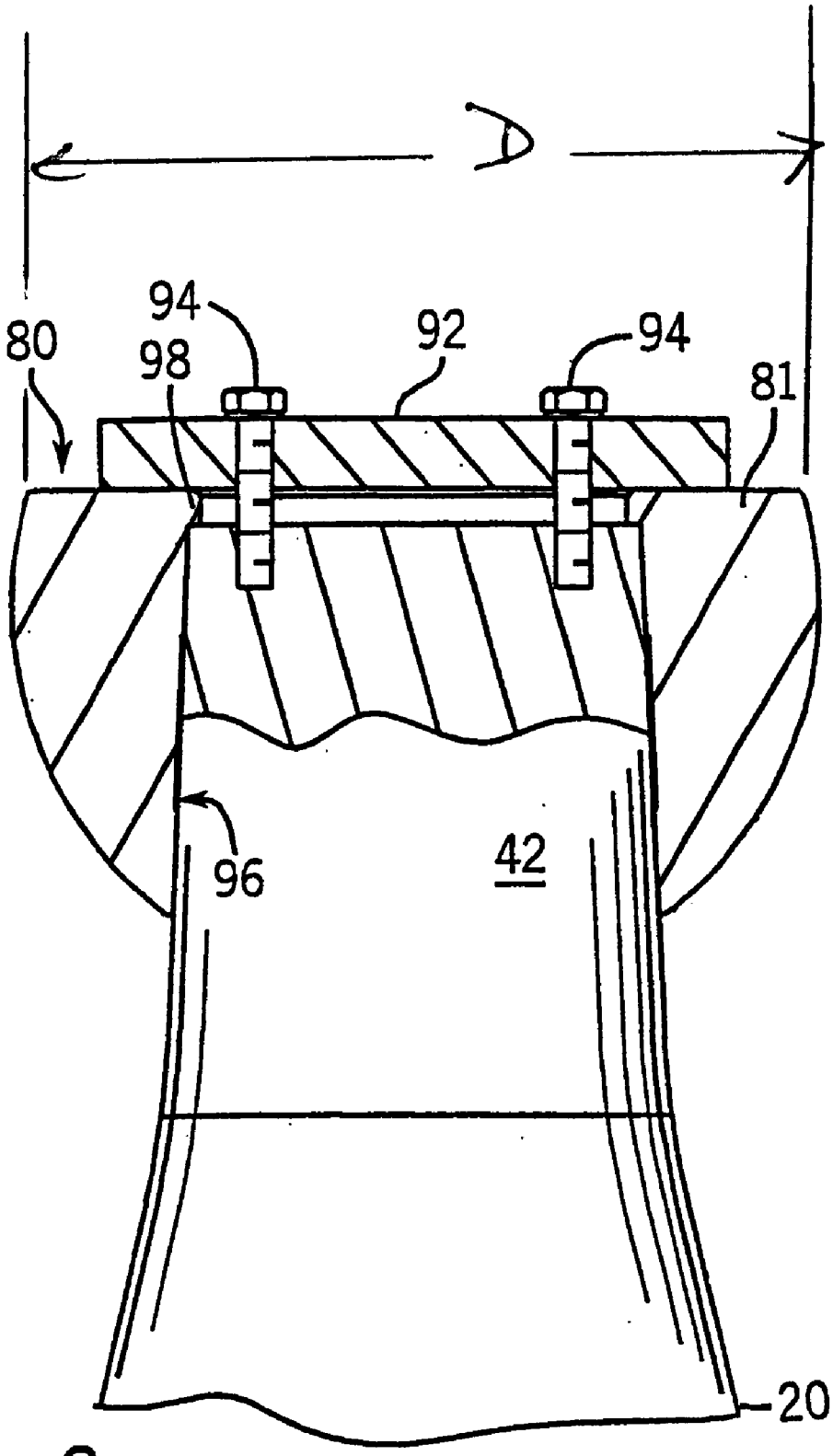
FIG. 2 is a more detailed cross-sectional view of the bearing and retainer of a gyratory crusher.

Referring now to FIG. 2, shaft 20 is supported within bearing 80 by a bearing retainer plate 92 and bearing retainer bolts 94. Bearing retainer plate 92 is made of steel, has a diameter of about twenty-one inches and is about two and one-half inches thick. Ball 81 has a flat surface on top, upon which bearing retainer plate 92 may rest. Bearing retainer plate 92 is attached to shaft 20 by bearing retainer bolts 94.

In a preferred embodiment, a bearing lip 98 extends partially into the space between shaft 20 and bearing retainer plate 92. The lip 98 has a thickness of about one inch and extends about one-half inch inward from the perimeter of shaft 20. Thus, in a preferred embodiment, the lip 98 has an inner diameter of about fourteen inches. Because the diameter of the bearing retainer plate 92 is greater than that of the inner diameter of the ball 81, the plate 92 overlays ball 81 with an annular contact surface area of about 190 square inches, having an inner diameter of fourteen inches and an outer diameter of twenty-one inches.

In the preferred embodiment, the bearing retainer bolts 94 are M30×120 mm steel bolts. There are preferably 10 bearing retainer bolts 94 clamping the plate 92 to the shaft 20. There are no threads on the shaft 20 at the interface 96 between ball 81 and shaft 20. Threads are not necessary because shaft 20 is supported by bearing retainer bolts 94.

The bearing retainer plate system precludes the need for a nut threaded on shaft 20 to secure ball 81 to shaft 20. Because no nut is used, no hydraulic system is necessary to apply assembly loads between ball 81 and shaft 20. Instead, a clamping load and assembly load are provided by bolts 94. The lack of threads on the exterior of the shaft 20 reduces possible stresses on and resultant damage to the shaft 20.

Bearing 80 must support shaft 20 while allowing gyratory motion. These loads can be substantial as shaft 20 weighs twenty-four tons in a preferred embodiment. The bolts 94 and bearing retainer plate 92 can be designed to support that load.

Additionally, bearing retainer bolts 94 resist loads due to the gyratory motion of shaft 20. Shaft 20 is generally constructed of steel, which may be threaded to allow bolts 94 to be attached. To support the loads of shaft 20 during crusher 10 operation, the bolts 94 are threaded two inches into shaft 20 in the preferred embodiment.

In the preferred embodiment, bearing retainer plate 92 is easily removed from shaft 20 and bearing 80 for repair and replacement. This is an advantage over systems using a large nut to clamp ball 81 onto shaft 20 because systems using a large nut have an additional hydraulic system as well as an apparatus required to prevent nut from loosening during operation. Therefore, the present bearing retainer plate device is superior to conventional designs with respect to ease of installation and maintenance.

The gyratory crusher 10 operates as follows. When the drive mechanism 22 is driven by any appropriate means, it transmits power to the eccentric 24. The eccentric 24 causes the gyration of the head assembly 26, resulting in the crushing of the material in the crushing chamber 50. The phantom lines flanking the mantle and center axis on FIG. 1 indicate the range of gyratory motion.

The above arrangement solves the longstanding problems discussed in the Background of the Invention section because the exterior of the shaft 20 does not require threads that increase stresses on the shaft 20 and are susceptible to breakage and wear. Additionally, the low cost and simplicity of the bearing retainer plate system is superior to the complicated retaining systems of the prior art. Finally, the bearing retainer plate 92 and bolts 94 may be more easily removed and installed than prior systems. This allows for more efficient maintenance and installation which results in lower costs.

While several embodiments of the invention have been described, it should be apparent to those skilled in the art that what has been described is considered at present to be the preferred embodiments of a bearing retainer system. However, in accordance with the patent statutes, changes may be made in the design without actually departing from the true spirit and scope of this invention. The following claims are intended to cover all such changes and modifications which fall within the true spirit and scope of this invention.

What is claimed is:

1. A bearing retainer apparatus in combination with a gyratory crusher, comprising:

a bearing including a ball;

an upright shaft disposed within the ball; and a plate attached to a top end of the shaft, and configured to prevent the ball from moving upward on the shaft;

the ball being of hemispherical shape having a longer horizontal dimension at an upper end thereof than at a lower end thereof;

the upper end of the ball including an annular lip disposed between an underside of the plate and the top end of the shaft and forming a gap therebetween;

the plate extending horizontally outwardly past an outer periphery of the top end of the shaft.

2. The bearing retainer apparatus of claim 1 wherein the ball is a hemispherical ball.

3. The bearing retainer apparatus of claim 2 wherein the ball has an annular lip extending between the shaft and the plate.

4. The bearing retainer apparatus of claim 1 wherein the plate is about 2.4 inches thick, and has a radius of about 10.4 inches.

5. The bearing retainer apparatus of claim 1 wherein the plate is made of steel.

6. The bearing retainer apparatus of claim 1 wherein the plate is secured to the shaft by a plurality of bolts.

7. A gyratory crusher, comprising:

a shell;

an upright shaft disposed within the shell;

a spider coupled to the shell;

a bearing disposed within the spider, the bearing having a ball into which a top end of the shaft extends; and a bearing retainer plate attached to the top end of the shaft for clamping the ball to the shaft;

the ball being of hemispherical shape having a longer horizontal dimension at an upper end thereof than at a lower end thereof;

the upper end of the ball including an annular lip disposed between an underside of the plate and the top end of the shaft and forming a gap therebetween;

the plate extending horizontally outwardly past an outer periphery of the top end of the shaft.

8. The gyratory crusher of claim 7 wherein the ball is a hemispherical ball.

9. The gyratory crusher of claim 8 wherein the ball has a lip extending between the shaft and the bearing retainer plate.

10. The gyratory crusher of claim 7 wherein the plate has a thickness of about 2.4 inches and a radius of about 10.4 inches.

11. The gyratory crusher of claim 7 wherein the bearing retainer plate is attached to the shaft by a plurality of bolts.

12. The gyratory crusher of claim 7 wherein the bearing retainer plate is made of steel.

* * * * *